US005501085A

United States Patent [19]

Chen

[11] Patent Number: 5,501,085

[45] **Date of Patent: *Mar. 26, 1996**

[54] FABRIC HOLDING-DOWN MECHANISM FOR DOUBLE KNIT MACHINES

[75] Inventor: Wan-Yih Chen, Taipei, Taiwan

[73] Assignee: Pai Lung Machinery Mill Co., Ltd., Taipei, Taiwan

[ * ] Notice: The term of this patent shall not extend beyond the expiration date of Pat. No. 5,386,711.

[21] Appl. No.: 324,670

[22] Filed: Oct. 18, 1994

Related U.S. Application Data

[63] Continuation-in-part of Ser. No. 141,509, Oct. 27, 1993, Pat. No. 5,386,711.

[51] Int. Cl.[6] ..... D04B 15/06

[52] U.S. Cl. ..... 66/104; 66/107; 66/19

[58] Field of Search ..... 66/19, 20, 25, 66/52, 57, 58, 95, 106, 107, 120

[56] References Cited

U.S. PATENT DOCUMENTS 2,783,629 3/1957 Lawson ..... 66/19 X 5,386,711 2/1995 Chen ..... 66/19

*Primary Examiner*—John J. Calvert

*Attorney, Agent, or Firm*—Bacon & Thomas

[57] ABSTRACT

A fabric holding-down sinker for a double knit machine to stop the knitted fabric from being lifted during the raising stitch of the cylinder needles. A series of such presser sinkers are reciprocated radially relative to the cylinder needles, each presser sinker having a projecting sinker head horizontally disposed at a front end. The projecting sinker head is moved to a front limit position spaced above a topmost edge of a fabric formation surface of the knitting machine at a distance equal to the thickness of the fabric being knitted during the raising stitch of the respective cylinder needle, preventing the knitted fabric from being lifted by the cylinder needles.

2 Claims, 4 Drawing Sheets

FABRIC HOLDING-DOWN MECHANISM FOR DOUBLE KNIT MACHINES

CROSS REFERENCE TO RELATED APPLICATION

The present invention is a continuation-in-part of patent application Ser. No. 08/141,509, filed on Oct. 27, 1993 now U.S. Pat. No. 5,386,711.

BACKGROUND OF THE INVENTION

The present invention relates to a fabric holding down sinker which prevents the fabric from being lifted from the cylinder needles during the knitting operation.

UK Patent Application GB 2199341 discloses a circular knitting machine having a plurality of needles movable longitudinally on the cylinder to perform knitting, a ring around the needle cylinder for being driven therewith. In order to prevent the fabric from being lifted, holding-down sinkers are provided and mounted on the ring and moved radially with respect to the needle cylinder.

There is known another knitting machine for forming terry cloth fabric, disclosed in "IMPROVED DOUBLE LOOP KNIT FABRIC, MACHINE AND METHOD" of UK Patent No. 1 534 575, which comprises a plurality of needles having latches pivotally attached thereto which move between open and closed positions, jack means for operating the needles, and pairs of sinkers for cooperating with the needles for forming loops. The two sinkers of the same pair have one with a sinker throat and the other with a sinker ledge. The sinkers are not provided to hold down the fabric.

The present invention discusses double knit machines. Regular double knit machines are commonly used for knitting plain cotton cloths having no raised patterns, and therefore the dial and the cylinder needles are controlled to complete cycles of knitting through a knit stitch knitting process, and the dial and cylinder needles of each knitting unit constrain each other, i.e. the fully extended out dial needles will press on the edges of the fabric to stop the fabric from being lifted during the raising stitch. These double knit machines have now been commonly used for knitting pique cloths having raised patterns on both sides. In knitting pique cloths, the cylinder needles (or dial needles) may be retainer immovable causing the fabric to be lifted during the raising stitch. In order to eliminate this problem, the present inventor invented a sinker assembly for double knit machine, as disclosed in "DOUBLE KNIT MACHINE FOR KNITTING CONSTRUCTIVE FABRICS" under U.S. patent application Ser. No. 08/141,509, filed on Oct. 27, 1994. The sinker assembly is installed in the casing of the double knit machine corresponding to a respective cylinder needle, comprised of a fixed sinker for supporting and guiding the knitted fabric, and a presser sinker disposed in parallel with the fixed sinker and reciprocated radially to press on the duly knitted fabric during each raising stitch of the needle cylinder so as to prohibit the duly knitted fabric from being lifted by the cylinder needle. This structure of sinker assembly is functional, however it is still complicated in structure because it consists of a presser sinker and a fixed sinker.

SUMMARY OF THE INVENTION

The present invention is an improvement on the disclosure of "Machine de tricotage double pour tricoter un tissu construit" of Franch Patent Application No. 9313888.

The present invention eliminates the fixed sinker from the sinker assembly. When only the presser sinker is installed, same function is achieved. When the presser sinker is reciprocated radially, the projecting sinker head of the presser sinker will be moved to a front limit position spaced above the topmost edge of the fabric formation surface on the knitting machine at a distance equal to the thickness of the fabric duly knitted during the raising stitch of the respective cylinder needle, and therefore the duly knitted fabric is retained from being lifted by the cylinder needle.

DETAILED DESCRIPTION OF THE PREFERRED EMBODIMENT

Figure 4:
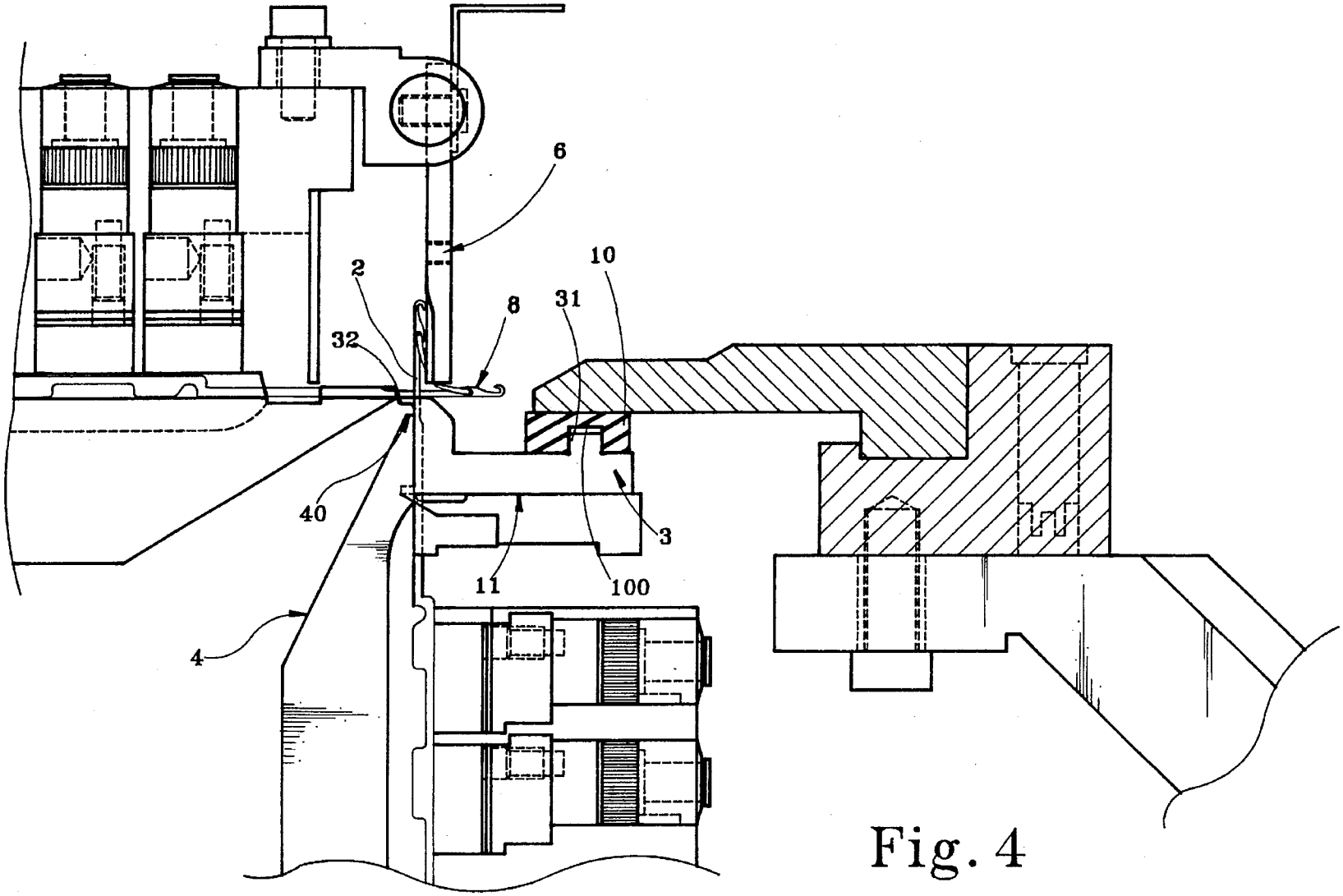
FIG. 4 is a side view, partially in cross-section view of a double knit machine according to the present invention, showing the position of the presser sinker.
Figure 5:
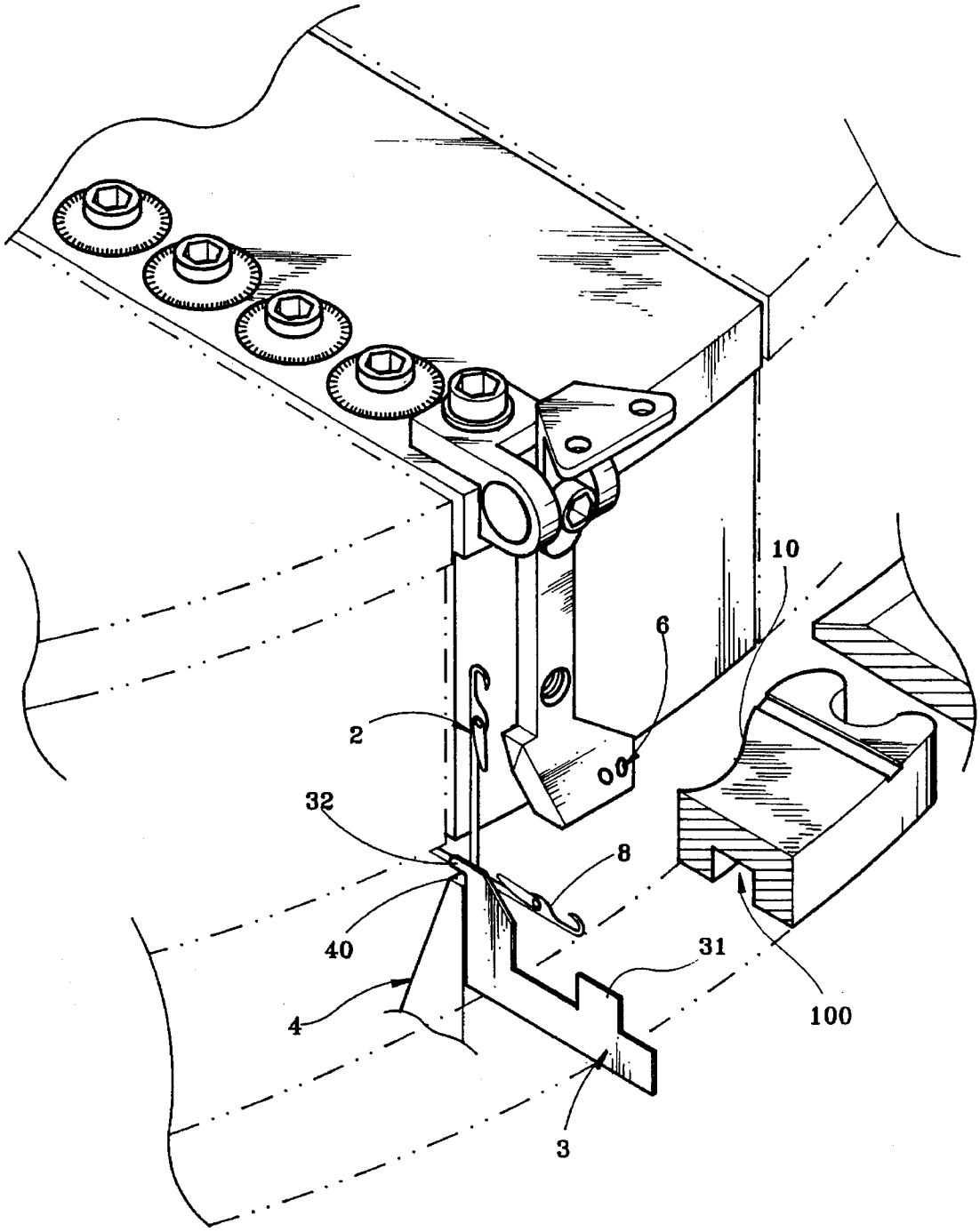
FIG. 5 is a partial perspective view of the apparatus of FIG. 4.

Referring to FIGS. 4 and 5, the circular knitting machine comprises a series of dial needles 8 radially arranged on the same horizontal plane, and a series of cylinder needles 2 vertically disposed corresponding to the series of dial needles. The dial needles and the cylinder needles 8 and 2 form into a series of knitting units. As the knitting machine is operated, the dial needle 8 and the cylinder needle 2 are respectively reciprocated at right angles and moved across each other around the top 40 of a fabric formation surface 4, and therefore loops are respectively cast off from the thread fed through a thread hole 6 and then formed into a fabric. The fabric 5 thus formed is then gradually sent out downward through the fabric formation surface 4.

The main feature of the present invention is the installation of a fabric holding-down mechanism in the circular knitting machine to stop the fabric 5 from being lifted during the knitting process. The fabric holding-down mechanism comprises a presser sinker 3, which is reciprocated horizontally, a cam 10 fixedly mounted on the needle cylinder of the knitting machine, which controls the movement of the presser sinker 3, and the top 40 of the aforesaid fabric formation surface. The presser sinker is disposed in a respective radial slot 11 on the knitting machine and moved as the needle cylinder of the knitting machine is rotated. The presser sinker 3 comprises an upright guide strip 31 on the top in the middle inserted in a track 100 on the bottom of the cam 10. As the cam 10 is moved the presser sinker 31 is reciprocated radially.

Figure 1:
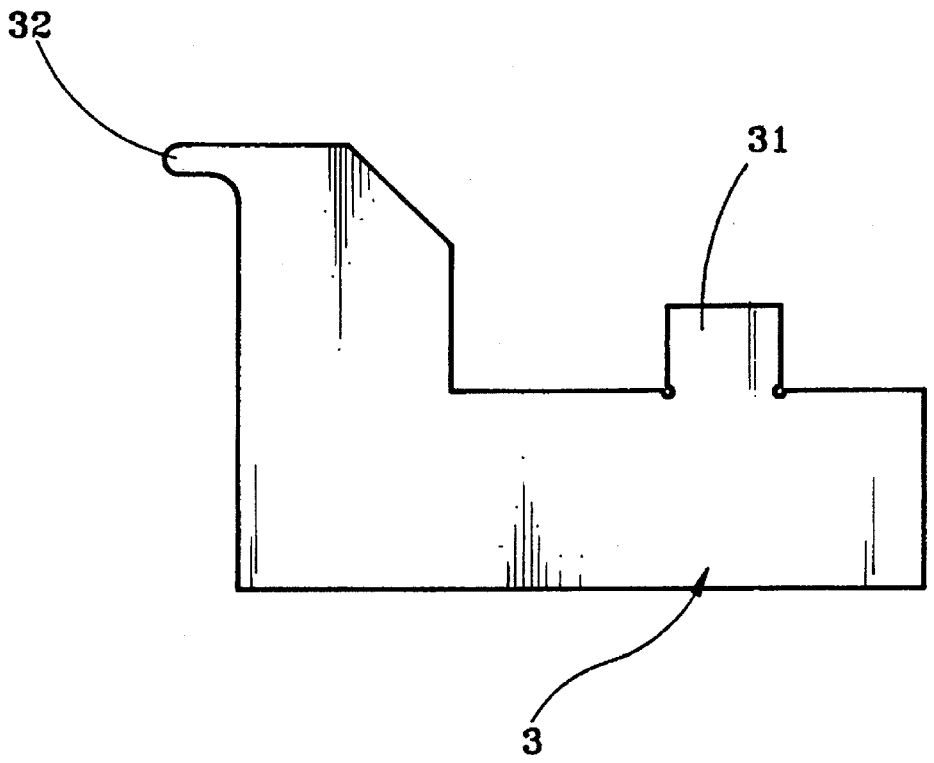
FIG. 1 is an elevational view of a presser sinker according to the present invention.

As shown in FIG. 1, the presser sinker 3 further comprises a projecting sinker head 32 horizontally disposed at a front end thereof. As the presser sinker 3 is moved forward to the front limit, the projecting sinker head 32 is disposed above the top 40 and spaced from the top 40 at a distance 320 approximately equal to the thickness of the fabric 5 (see FIG. 2).

Figure 2:
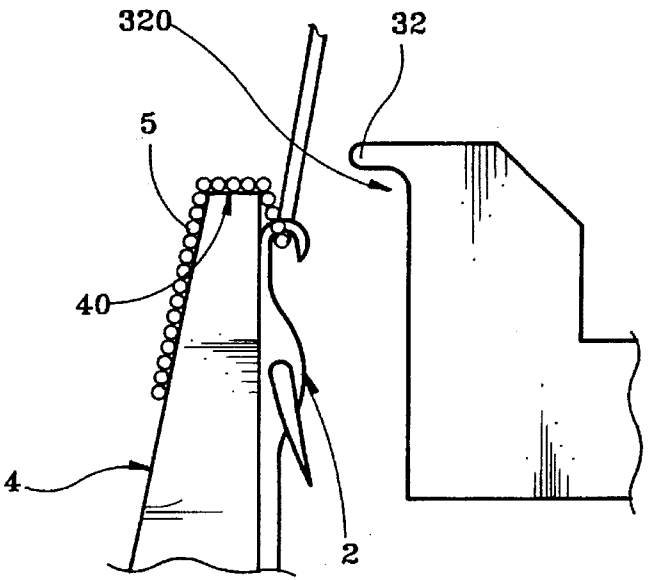
FIG. 2 shows the projecting sinker head pressed on the duly knitted fabric during the raising stitch of the cylinder needle according to the present invention.
Figure 3:
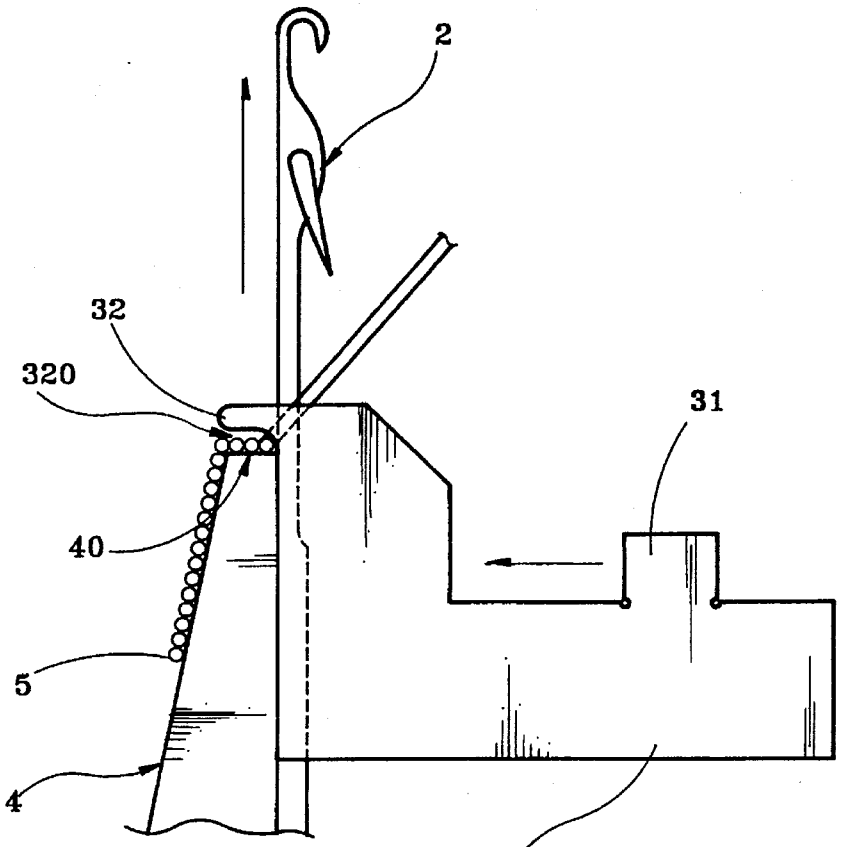
FIG. 3 shows the cylinder needle received back and the presser sinker removed from the fabric according to the present invention.

Referring to FIGS. 2 and 3, when the cylinder needle 2 is received back during its declining stitch, the projecting sinker head 32 of the presser sinker 31 is moved backwards; when the cylinder needle 2 is vertically moved upward during its raising stitch, the projecting sinker head 32 of the presser sinker 31 is moved to the front limit above the top 40 and pressed on the duly knitted fabric 5. Therefore, the duly knitted fabric 5 will not be lifted by the cylinder needle 2 during the knitting process.

I claim:

1. A presser sinker for a knitting machine having a fabric formation surface with a topmost edge, comprising:

a) a sinker body having a front edge; and b) a projecting sinker head projecting outwardly beyond the front edge and located such that, when the front edge is adjacent to the fabric formation surface, the projecting sinker head is disposed above the topmost edge of the fabric formation surface.

2. The presser sinker of claim 1 further comprising an upright guide strip projecting from the sinker body.

* * * * *